US011098269B2

(12) United States Patent
Bauer et al.

(10) Patent No.: US 11,098,269 B2
(45) Date of Patent: Aug. 24, 2021

(54) COMPOSITION SUITABLE AS SURFACTANT

(71) Applicant: BASF SE, Ludwigshafen am Rhein (DE)

(72) Inventors: Frederic Bauer, Ludwigshafen am Rhein (DE); Claudia Esper, Ludwigshafen am Rhein (DE)

(73) Assignee: BASF SE, Ludwigshafen am Rhein (DE)

( * ) Notice: Subject to any disclaimer, the term of this patent is extended or adjusted under 35 U.S.C. 154(b) by 0 days.

(21) Appl. No.: 16/348,179

(22) PCT Filed: Nov. 7, 2017

(86) PCT No.: PCT/EP2017/078511
§ 371 (c)(1),
(2) Date: May 8, 2019

(87) PCT Pub. No.: WO2018/087105
PCT Pub. Date: May 17, 2018

(65) Prior Publication Data

US 2019/0367838 A1 Dec. 5, 2019

(30) Foreign Application Priority Data

Nov. 8, 2016 (EP) ..... 16197759

(51) Int. Cl.

| | |
|---|---|
| ***C11D 1/825*** | (2006.01) |
| ***C11D 3/22*** | (2006.01) |
| ***C11D 11/00*** | (2006.01) |
| ***C11D 17/06*** | (2006.01) |
| *C11D 1/66* | (2006.01) |

(52) U.S. Cl.
CPC ..... *C11D 1/825* (2013.01); *C11D 11/0017* (2013.01); *C11D 17/065* (2013.01); *C11D 1/667* (2013.01)

(58) Field of Classification Search
CPC ..... C11D 1/662; C11D 1/825; C11D 3/22
See application file for complete search history.

(56) References Cited

U.S. PATENT DOCUMENTS

| | | | | |
|---|---|---|---|---|
| 5,670,471 | A * | 9/1997 | Amalric | C11D 3/202 510/416 |
| 5,753,606 | A | 5/1998 | Hees et al. | |
| 5,856,290 | A * | 1/1999 | van Buskirk | C11D 1/835 510/382 |
| 6,462,006 | B1 | 10/2002 | Sorg et al. | |
| 9,845,446 | B2 * | 12/2017 | Bauer | C11D 1/825 |
| 2001/0056047 | A1 * | 12/2001 | Meine | C11D 1/8255 510/111 |
| 2019/0119606 | A1 | 4/2019 | Bauer et al. | |
| 2019/0185784 | A1 | 6/2019 | Bauer et al. | |

FOREIGN PATENT DOCUMENTS

| | | | | |
|---|---|---|---|---|
| DE | 4400637 | A1 | 7/1995 | |
| DE | 19819187 | A1 | 11/1999 | |
| EP | 0851023 | A2 | 7/1998 | |
| EP | 2998311 | A1 | 3/2016 | |
| WO | WO-2008135646 | A1 | 11/2008 | |
| WO | WO 2014/146958 | * | 9/2014 | C11D 1/83 |
| WO | WO-2015091160 | A1 | 6/2015 | |
| WO | WO-2017167599 | A1 | 10/2017 | |

OTHER PUBLICATIONS

U.S. Appl. No. 16/310,256, filed Dec. 14, 2018.
European Search Report for EP Patent Application No. 16197759.0, dated Mar. 10, 2017.
International Search Report for PCT/EP2017/078511 dated Jan. 30, 2018.
Written Opinion of the International Searching Authority for PCT/EP2017/078511 dated Jan. 30, 2018.

* cited by examiner

*Primary Examiner* — Brian P Mruk
(74) *Attorney, Agent, or Firm* — Faegre Drinker Biddle & Reath LLP

(57) ABSTRACT

The present invention refers to a composition comprising two or more compounds of the general formula (I), a dry or liquid formulation comprising said composition as well as the use of said composition as surfactant or as anti-greying agent in a laundry process.

11 Claims, No Drawings

COMPOSITION SUITABLE AS SURFACTANT

CROSS-REFERENCE TO RELATED APPLICATIONS

This application is a national stage application (under 35 U.S.C. § 371) of PCT/EP2017/078511, filed Nov. 7, 2017, which claims benefit of European Application No. 16197759.0, filed Nov. 8, 2016, both of which are incorporated herein by reference in their entirety.

FIELD OF THE INVENTION

The present invention refers to a composition comprising two or more compounds of the general formula (I), a dry or liquid formulation comprising said composition as well as the use of said composition as surfactant or as anti-greying agent in a laundry process.

BACKGROUND OF THE INVENTION

Detergent compositions are well known in the art and can be formulated in a number of different ways to address a number of different problems. For example, such compositions may comprise a great variety of compounds such as builders, optical brighteners, dispersants, enzymes, perfumes, surfactants (anionic, nonionic, cationic and/or amphoteric), soaps, silicon based defoamers, bleaching agents, colorants, dye transfer inhibitors, complexing agents etc., in order to address various problems encountered in cleaning processes. Furthermore, such compositions are typically formulated such that they are effective against the broadest possible spectrum of stains. This need is addressed by providing compositions comprising one or more agent(s) which is/are broadly effective in their cleaning performance.

However, one particular problem which arises during the washing process of laundry is that the used surfactant do not provide sufficient efficiency at low dosage such that high amounts of surfactant are typically needed. Another problem is that redeposition of soil typically occurs which leads to a general greying of fabrics. In order to reduce redeposition of soil, specific native or modified polysaccharides such as polysaccharides treated with gaseous or liquid $SO_2$ (see e.g. WO 2015/091160 A1) have been developed and can be added to the laundry formulation. However, the anti-greying performance of such compounds is still not sufficient.

Therefore, there is a continuous need in the art for providing a compound or composition which avoids the foregoing disadvantages and especially provides a high efficiency as surfactant.

Furthermore, it is desirable to provide a compound or composition which reduces greying of a washed fabric. In addition thereto, it is desirable to provide a surfactant and anti-greying agent which can be formulated in a dry or liquid formulation.

Accordingly, it is an object of the present invention to provide a compound or composition that can be used as surfactant. Furthermore, it is an object of the present invention to provide a compound or composition which reduces greying of a washed fabric. It is an even further object of the present invention to provide a compound or composition that can be used in dry or liquid formulations.

SUMMARY OF THE INVENTION

The foregoing and other objects are solved by the subject-matter of the present invention.

According to a first aspect of the present invention, a composition comprising two or more compounds of the general formula (I),

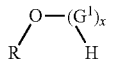

(I)

wherein R is unsubstituted linear $C_8$-$C_{20}$-alkyl, $G^1$ is selected from glucose, arabinose, rhamnose, xylose and mixtures thereof; x is in the range of from 1 to 10 and refers to average values, and wherein the two or more compounds differ in R and/or $G^1$ and/or x, is provided.

The inventors surprisingly found out that the composition comprising two or more compounds of the general formula (I), as defined herein, shows high efficiency as surfactant and thus can be used as surfactant. Furthermore, the composition comprising two or more compounds of the general formula (I), as defined herein, reduces greying of a washed fabric and thus can be used as anti-greying agent. Furthermore, the composition comprising two or more compounds of the general formula (I), as defined herein, can be formulated in a dry or liquid formulation.

According to a further aspect of the present invention, a dry or liquid formulation comprising the composition comprising two or more compounds of the general formula (I), as defined herein, is provided. In one embodiment, the formulation further comprises additives selected from the group comprising anionic surfactants, nonionic surfactants, cationic surfactants, amphoteric surfactants, enzymes, bleaching agents, peroxygen compounds, optical brightener, complexing agents, polymers, e.g. polycarboxylates, soaps, silicon based defoamers, bleaching agents, colorants, dye transfer inhibitors and mixtures thereof. In another embodiment, the formulation is a single dose formulation or a high concentrated powder formulation having a bulk density of above 600 g/l.

According to still another aspect of the present invention, the use of the composition comprising two or more compounds of the general formula (I), as defined herein, as surfactant is provided.

Preferably, the composition comprising two or more compounds of the general formula (I), as defined herein, is used as surfactant in a laundry process.

According to an even further aspect of the present invention, the use of the composition comprising two or more compounds of the general formula (I), as defined herein, as anti-greying agent in a laundry process is provided.

Advantageous embodiments of the inventive compound of the general formula (I) are defined in the corresponding sub-claims.

According to one embodiment, in the general formula (I) R is unsubstituted linear $C_{10}$-$C_{20}$-alkyl, preferably unsubstituted linear $C_{10}$-$C_{18}$-alkyl, even more preferably unsubstituted linear $C_{12}$-$C_{18}$-alkyl, and most preferably a mixture of unsubstituted linear $C_{12}$-alkyl, $C_{14}$-alkyl, $C_{16}$-alkyl and $C_{14}$-alkyl.

According to another embodiment, in the general formula (I) R is a mixture of unsubstituted linear $C_{12}$-alkyl and $C_{14}$-alkyl.

According to yet another embodiment, in the general formula (I) $G^1$ is arabinose and/or rhamnose, or $G^1$ is a mixture of glucose, arabinose and xylose.

According to one embodiment, in the general formula (I) x is in the range of from 1.05 to 2.5 and preferably in the range of from 1.10 to 1.8.

According to another embodiment, in the general formula (I) R is unsubstituted linear $C_{10}$-$C_{18}$-alkyl, and $G^1$ is arabinose and/or rhamnose and x is in the range of from 1.05 to 2.5.

According to yet another embodiment, in the general formula (I) R is unsubstituted linear $C_{12}$-$C_{18}$-alkyl and $G^1$ is arabinose and/or rhamnose and x is in the range of from 1.10 to 1.8.

According to one embodiment, the two or more compounds of the general formula (I) differ in R.

In the following, the details and preferred embodiments of the inventive composition comprising two or more compounds of the general formula (I) will be described in more detail. It is to be understood that these technical details and embodiments also apply to the inventive dry or liquid formulation and uses.

DETAILED DESCRIPTION OF THE INVENTION

A composition comprising two or more compounds of the general formula (I),

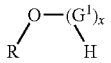

(I)

wherein R is unsubstituted linear $C_8$-$C_{20}$-alkyl, $G^1$ is selected from glucose, arabinose, rhamnose, xylose and mixtures thereof; x is in the range of from 1 to 10 and refers to average values, and wherein the two or more compounds differ in R and/or $G^1$ and/or x is provided.

It was surprisingly found out by the inventors that said composition comprising two or more compounds of the general formula (I) shows high efficiency as surfactant and thus can be used as surfactant. Furthermore, it was found out that said composition comprising two or more compounds of the general formula (I) reduces greying of a washed fabric and thus can be used as anti-greying agent, especially in laundry processes.

In the general formula (I), R is unsubstituted linear $C_8$-$C_{20}$-alkyl, preferably unsubstituted linear $C_{10}$-$C_{20}$-alkyl, more preferably unsubstituted linear $C_{10}$-$C_{18}$-alkyl, and most preferably unsubstituted linear $C_{12}$-$C_{18}$-alkyl. For example, R is unsubstituted linear $C_{12}$-$C_{14}$-alkyl.

It is appreciated that R is preferably obtained by hydrogenation of fatty acids or their methyl esters, which processes are well known in the art.

As used herein, the term "linear alkyl" is a radical of a saturated linear aliphatic group. The expression "linear" is intended to mean that the average number of branching in the alkyl group does not exceed 0.5 and preferably is 0.

As used herein, the phrase average number of branches per molecule chain refers to the average number of branches per alcohol molecule which corresponds to the corresponding branched alkyl, as measured by $^{13}C$ Nuclear Magnetic Resonance ($^{13}C$ NMR). The average number of carbon atoms in the chain are determined by gas chromatography.

Various references will be made throughout this specification and the claims to the percentage of branching at a given carbon position, the percentage of branching based on types of branches, average number of branches, and percentage of quaternary atoms. These amounts are to be measured and determined by using a combination of the following three $^{13}C$-NMR techniques.

(1) The first is the standard inverse gated technique using a 45-degree tip $^{13}C$ pulse and 10 s recycle delay (an organic free radical relaxation agent is added to the solution of the branched alcohol in deuterated chloroform to ensure quantitative results). (2) The second is a J-Modulated Spin Echo NMR technique (JMSE) using a 1/J delay of 8 ms (J is the 125 Hz coupling constant between carbon and proton for these aliphatic alcohols). This sequence distinguishes carbons with an odd number of protons from those bearing an even number of protons, i.e. $CH_3$/CH vs $CH_2$/Cq (Cq refers to a quaternary carbon) (3) The third is the JMSE NMR "quatonly" technique using a ½J delay of 4 ms which yields a spectrum that contains signals from quaternary carbons only. The JSME NMR quatonly technique for detecting quaternary carbon atoms is sensitive enough to detect the presence of as little at 0.3 atom % of quaternary carbon atoms. As an optional further step, if one desires to confirm a conclusion reached from the results of a quatonly JSME NMR spectrum, one may also run a DEPT-135 NMR sequence. The DEPT-135 NMR sequence may be very helpful in differentiating true quaternary carbons from breakthrough protonated carbons. This is due to the fact that the DEPT-135 sequence produces the "opposite" spectrum to that of the JMSE "quatonly" experiment. Whereas the latter nulls all signals except for quaternary carbons, the DEPT-135 nulls exclusively quaternary carbons. The combination of the two spectra is therefore very useful in spotting non quaternary carbons in the JMSE "quatonly" spectrum. When referring to the presence or absence of quaternary carbon atoms throughout this specification, however, it is meant that the given amount or absence of the quaternary carbon is as measured by the quatonly JSME NMR method. If one optionally desires to confirm the results, then also using the DEPT-135 technique to confirm the presence and amount of a quaternary carbon.

Thus, it is not excluded that the inventive composition comprises minor amounts of R being unsubstituted branched $C_9$-$C_{15}$-alkyl, i.e. $C_9$-$C_{15}$-alkyl having an average number of branching of above 0.9, e.g. from 0.9 to 3.5. For example, the composition comprising two or more compounds of the general formula (I), comprises one or more compounds, wherein R is unsubstituted branched $C_9$-$C_{15}$-alkyl, in an amount of ≤1.0 wt.-%, based on the total weight of the composition.

The term "unsubstituted" means that the linear alkyl group is free of substituents, i.e. the linear alkyl group is composed of carbon and hydrogen atoms only.

In one embodiment, the two or more compounds of the composition differ in R. Preferably, the composition comprises a mixture of two or more compounds of the general formula (I) differing in R, while $G^1$ and x are the same. If the two or more compounds of the composition differ in R, R preferably differs in the number of carbon atoms (i.e. the length).

For example, if the two or more compounds of the composition differ in the number of carbon atoms (i.e. the length), one of the two or more compounds is a compound, wherein R is unsubstituted linear $C_{12}$-alkyl, and one or more compound(s) of the two or more compounds is a compound, wherein R is unsubstituted linear $C_8$-alkyl, unsubstituted linear $C_{10}$-alkyl, unsubstituted linear $C_{14}$-alkyl, unsubstituted linear $C_{16}$-alkyl, unsubstituted linear $C_{18}$-alkyl and/or unsubstituted linear $C_{20}$-alkyl. Alternatively, one of the two or more compounds is a compound, wherein R is unsubstituted linear $C_{14}$-alkyl, and one or more compound(s) of the two or more compounds is a compound, wherein R is unsubstituted linear $C_8$-alkyl, unsubstituted linear $C_{10}$-alkyl, unsubstituted linear $C_{12}$-alkyl, unsubstituted linear $C_{16}$-alkyl, unsubstituted linear $C_{18}$-alkyl and/or unsubstituted linear $C_{20}$-alkyl. Alternatively, one of the two or more compounds is a compound, wherein R is unsubstituted linear $C_{16}$-alkyl, and one or more compound(s) of the two or more compounds is a compound, wherein R is unsubstituted linear $C_8$-alkyl, unsubstituted linear $C_{10}$-alkyl, unsubstituted linear $C_{12}$-alkyl, unsubstituted linear $C_{14}$-alkyl, unsubstituted linear $C_{18}$-alkyl and/or unsubstituted linear $C_{20}$-alkyl.

Preferably, the two or more compounds of the composition differ in R. Thus, R is preferably a mixture of different unsubstituted linear $C_8$-$C_{20}$-alkyl.

For example, R is a mixture of unsubstituted linear $C_8$-$C_{20}$-alkyl, i.e. unsubstituted linear $C_8$-alkyl, unsubstituted linear $C_{10}$-alkyl, unsubstituted linear $C_{12}$-alkyl, unsubstituted linear $C_{14}$-alkyl, unsubstituted linear $C_{16}$-alkyl, unsubstituted linear $C_{18}$-alkyl and unsubstituted linear $C_{20}$-alkyl. Preferably, R is a mixture of unsubstituted linear $C_{10}$-$C_{20}$-alkyl, i.e. unsubstituted linear $C_{10}$-alkyl, unsubstituted linear $C_{12}$-alkyl, unsubstituted linear $C_{14}$-alkyl, unsubstituted linear $C_{16}$-alkyl, unsubstituted linear $C_1$-alkyl and unsubstituted linear $C_{20}$-alkyl. More preferably, R is a mixture of unsubstituted linear $C_{12}$-$C_{18}$-alkyl, i.e. unsubstituted linear $C_{12}$-alkyl, unsubstituted linear $C_{14}$-alkyl, unsubstituted linear $C_{16}$-alkyl and unsubstituted linear $C_{18}$-alkyl. Most preferably, R is a mixture of unsubstituted linear $C_{12}$-$C_{14}$-alkyl, i.e. unsubstituted linear $C_{12}$-alkyl, and unsubstituted linear $C_{14}$-alkyl.

In one embodiment, R is a mixture of unsubstituted linear $C_{12}$-alkyl, unsubstituted linear $C_{14}$-alkyl, unsubstituted linear $C_{16}$-alkyl and unsubstituted linear $C_{18}$-alkyl. Alternatively, R is a mixture of unsubstituted linear $C_{12}$-alkyl and unsubstituted linear $C_{14}$-alkyl.

It is appreciated that the amount of each of the two or more compounds of the composition differing in R may vary in a broad range. For example, if R comprises a mixture of unsubstituted linear $C_{12}$-$C_{14}$-alkyl, it is preferred that the ratio of unsubstituted linear $C_{12}$-alkyl to unsubstituted linear $C_{14}$-alkyl [$C_{12}/C_{14}$] is in the range from 6:1 to 1:1, more preferably from 5:1 to 2:1.

In one embodiment, the sum of the compounds of the general formula (I), wherein R is unsubstituted linear $C_{12}$-alkyl, in the composition is ≥35.0 wt.-%, more preferably ≥40.0 wt.-% and most preferably ≥45.0 wt.-%, such as from 45.0 to 80.0 wt.-% or from 45.0 to 75.0 wt.-%, based on the total weight of the composition.

Additionally or alternatively, the sum of the compounds of the general formula (I), wherein R is unsubstituted linear $C_{14}$-alkyl, in the composition is a 10.0 wt.-%, more preferably ≥12.0 wt.-% and most preferably ≥15.0 wt.-%, such as from 15.0 to 35.0 wt.-% or from 15.0 to 30.0 wt.-%, based on the total weight of the composition.

Additionally or alternatively, the sum of the compounds of the general formula (I), wherein R is unsubstituted linear $C_{16}$-alkyl, in the composition is ≤18.0 wt.-%, more preferably ≤16.0 wt.-% and most preferably ≤14.0 wt.-%, such as from 5.0 to 14.0 wt.-% or from 7.0 to 14.0 wt.-%, based on the total weight of the composition.

Additionally or alternatively, the sum of the compounds of the general formula (I), wherein R is unsubstituted linear $C_{18}$-alkyl, in the composition is ≤26.0 wt.-%, more preferably ≤24.0 wt.-% and most preferably ≤22.0 wt.-%, such as from 5.0 to 22.0 wt.-% or from 10.0 to 22.0 wt.-%, based on the total weight of the composition.

Additionally or alternatively, the sum of the compounds of the general formula (I), wherein R is unsubstituted linear $C_{20}$-alkyl, in the composition is ≤1.5 wt.-%, more preferably ≤1.2 wt.-% and most preferably ≤1.0 wt.-%, such as from 0.1 to 1.0 wt.-% or from 0.2 to 1.0 wt.-%, based on the total weight of the composition.

Additionally or alternatively, the sum of the compounds of the general formula (I), wherein R is unsubstituted linear $C_{10}$-alkyl, in the composition is ≤3.0 wt.-%, more preferably ≤2.5 wt.-% and most preferably ≤2.0 wt.-%, such as from 0.1 to 2.0 wt.-% or from 0.3 to 2.0 wt.-%, based on the total weight of the composition.

Additionally or alternatively, the sum of the compounds of the general formula (I), wherein R is unsubstituted linear $C_8$-alkyl, in the composition is ≤1.5 wt.-%, more preferably ≤1.2 wt.-% and most preferably ≤1.0 wt.-%, such as from 0.1 to 1.0 wt.-% or from 0.2 to 1.0 wt.-%, based on the total weight of the composition.

It is preferred that the sum of the compounds of the general formula (I), wherein R is unsubstituted linear $C_1$-alkyl and unsubstituted linear $C_{14}$-alkyl, in the composition is ≥45.0 wt.-%, more preferably ≥55.0 wt.-% and most preferably ≥60.0 wt.-%, such as from 60.0 to 100.0 wt.-% or from 60.0 to 85.0 wt.-%, based on the total weight of the composition.

For example, if in the general formula (I) R is a mixture of unsubstituted linear $C_{12}$-alkyl and unsubstituted linear $C_{14}$-alkyl, the sum of the compounds of the general formula (I), wherein R is unsubstituted linear $C_1$-alkyl and unsubstituted linear $C_{14}$-alkyl, in the composition is ≥75.0 wt.-%, more preferably ≥80.0 wt.-% and most preferably ≥85.0 wt.-%, such as from 85.0 to 100.0 wt.-% or from 85.0 to 97.0 wt.-%, based on the total weight of the composition. In this embodiment, the residual amount up to 100.0 wt.-% in the composition is made up of compounds of the general formula (I), wherein R is different from unsubstituted linear $C_{12}$-alkyl and unsubstituted linear $C_{14}$-alkyl, such as unsubstituted linear $C_{10}$-alkyl and/or unsubstituted linear $C_{16}$-alkyl and/or unsubstituted linear $C_{18}$-alkyl.

Alternatively, the sum of the compounds of the general formula (I), wherein R is unsubstituted linear $C_{12}$-alkyl, unsubstituted linear $C_{14}$-alkyl, unsubstituted linear $C_{16}$-alkyl and unsubstituted linear $C_{18}$-alkyl, in the composition is more than 70.0 wt.-%, more preferably more than 75.0 wt.-% and most preferably more than 80.0 wt.-%, such as from 80.0 to 100.0 wt.-% or from 80.0 to 96.0 wt.-%, based on the total weight of the composition. In this embodiment, the residual amount up to 100.0 wt.-% in the composition is made up of compounds of the general formula (I), wherein R is different from unsubstituted linear $C_1$-alkyl, unsubstituted linear $C_{14}$-alkyl, unsubstituted linear $C_{16}$-alkyl and unsubstituted linear $C_{18}$-alkyl, such as unsubstituted linear $C_8$-alkyl and/or unsubstituted linear $C_{20}$-alkyl.

The two or more compounds of the general formula (I) can be obtained by methods well known in the art, e.g. by the corresponding glycosylation of a mixture of alcohols.

In the general formula (I), $G^1$ is selected from glucose, arabinose, rhamnose, xylose and mixtures thereof. Preferably, $G^1$ in the general formula (I) is selected from the group consisting of glucose, arabinose, rhamnose, xylose and mixtures thereof. These monosaccharides may be synthetic or derived or isolated from natural products, hereinafter in brief referred to as natural saccharides or natural polysaccharides, and natural saccharides natural polysaccharides being preferred. Monosaccharides can be selected from any of their enantiomers, naturally occurring enantiomers and naturally occurring mixtures of enantiomers being preferred. Naturally, in a specific molecule only whole groups of $G^1$ can occur.

Thus, if $G^1$ in the general formula (I) is glucose, $G^1$ can be D-glucose, L-glucose and mixtures thereof, preferably D-glucose. If $G^1$ in the general formula (I) is arabinose, $G^1$ can be D-arabinose, L-arabinose and mixtures thereof, preferably L-arabinose. If $G^1$ in the general formula (I) is xylose, $G^1$ can be D-xylose, L-xylose and mixtures thereof, preferably D-xylose. If $G^1$ in the general formula (I) is rhamnose, $G^1$ can be D-rhamnose, L-rhamnose and mixtures thereof, preferably L-rhamnose.

In one embodiment, $G^1$ in the general formula (I) is selected from the group consisting of arabinose, preferably D-arabinose, rhamnose, preferably L-rhamnose, xylose, preferably D-xylose, and mixtures of the foregoing. Preferably, $G^1$ in the general formula (I) is selected from the group consisting of arabinose, preferably D-arabinose, rhamnose, preferably L-rhamnose, and mixtures of the foregoing. Most preferably, $G^1$ in the general formula (I) is arabinose, preferably D-arabinose.

In one embodiment, $G^1$ is selected from arabinose, rhamnose, xylose and mixtures thereof. Preferably, $G^1$ is selected from arabinose, rhamnose and xylose. In this embodiment, $G^1$ in the general formula (I) is preferably free of glucose. That is to say, $G^1$ in the general formula (I) is preferably free of D-glucose and/or L-glucose.

In one embodiment, $G^1$ is selected from glucose, arabinose, rhamnose, xylose and mixtures thereof, which are obtained from a fermentative process of a biomass source. The biomass source may be selected from the group comprising pine wood, beech wood, wheat straw, corn straw, switchgrass, flax, barley husk, oat husk, bagasse, miscanthus and the like.

Thus, it is appreciated that $G^1$ can comprise a mixture of glucose and/or arabinose and/or rhamnose and/or xylose.

Preferred mixtures include, but are not limited to, a mixture of arabinose and xylose or a mixture of arabinose and rhamnose or a mixture of xylose and rhamnose or a mixture of arabinose and rhamnose and xylose or a mixture of glucose and arabinose and xylose.

If the mixture comprises a mixture of xylose and arabinose, the weight ratio of xylose to arabinose may vary in a wide range, depending on the biomass source used. For example, if the mixture comprises a mixture of xylose and arabinose, the weight ratio of xylose to arabinose (xylose [wt.-%]/arabinose [wt.-%]) in the mixture is preferably from 150:1 to 1:10, more preferably from 100:1 to 1:5, even more preferably from 90:1 to 1:2 and most preferably from 80:1 to 1:1.

If the mixture comprises a mixture of xylose and rhamnose, the weight ratio of xylose to rhamnose may vary in a wide range, depending on the biomass source used. For example, if the mixture comprises a mixture of xylose and rhamnose, the weight ratio of xylose to rhamnose (xylose [wt.-%]/rhamnose [wt.-%]) in the mixture is preferably from 150:1 to 1:10, more preferably from 100:1 to 1:5, even more preferably from 90:1 to 1:2 and most preferably from 80:1 to 1:1.

if the mixture comprises a mixture of arabinose and rhamnose, the weight ratio of arabinose to rhamnose (arabinose [wt.-%]/rhamnose [wt.-%]) in the mixture is preferably from 150:1 to 1:10, more preferably from 100:1 to 1:5, even more preferably from 90:1 to 1:2 and most preferably from 80:1 to 1:1.

If the mixture comprises a mixture of arabinose and rhamnose and xylose, the weight ratio of arabinose to rhamnose to xylose may vary in a wide range, depending on the biomass source used. For example, if the mixture comprises a mixture of arabinose and rhamnose and xylose, the weight ratio of xylose to arabinose (xylose [wt.-%]/arabinose [wt.-%]) in the mixture is preferably from 150:1 to 1:10, more preferably from 100:1 to 1:5, even more preferably from 90:1 to 1:2 and most preferably from 80:1 to 1:1. Additionally or alternatively, the weight ratio of arabinose to rhamnose (arabinose [wt.-%]/rhamnose [wt.-%]) in the mixture is preferably from 150:1 to 1:20, more preferably from 120:1 to 1:15, even more preferably from 100:1 to 1:10 and most preferably from 80:1 to 1:8. Additionally or alternatively, the weight ratio of xylose to rhamnose (xylose [wt.-%]/rhamnose [wt.-%]) in the mixture is preferably from 150:1 to 1:20, more preferably from 120:1 to 1:15, even more preferably from 100:1 to 1:10 and most preferably from 80:1 to 1:8.

If the mixture comprises a mixture of glucose and arabinose and xylose, the weight ratio of glucose to arabinose to xylose may vary in a wide range, depending on the biomass source used. For example, if the mixture of monosaccharides with 5 or 6 carbon atoms comprises a mixture of glucose and xylose and arabinose, the weight ratio of glucose to arabinose (glucose [wt.-%]/arabinose [wt.-%]) in the mixture is preferably from 220:1 to 1:20, more preferably from 200:1 to 1:15, even more preferably from 190:1 to 1:10 and most preferably from 180:1 to 1:8. Additionally or alternatively, the weight ratio of xylose to arabinose (xylose [wt.-%]/arabinose [wt.-%]) in the mixture is preferably from 150:1 to 1:20, more preferably from 120:1 to 1:15, even more preferably from 100:1 to 1:10 and most preferably from 80:1 to 1:8. Additionally or alternatively, the weight ratio of glucose to xylose (glucose [wt.-%]/xylose [wt.-%]) in the mixture is preferably from 150:1 to 1:20, more preferably from 120:1 to 1:15, even more preferably from 100:1 to 1:10 and most preferably from 80:1 to 1:8.

In one embodiment, especially if $G^1$ is obtained from a fermentative process of a biomass source, $G^1$ may comprise minor amounts of monosaccharides differing from glucose, arabinose, rhamnose and/or xylose.

Preferably, $G^1$ comprises ≤10 wt.-%, more preferably ≤5 wt.-%, based on the total weight of the monosaccharide, of monosaccharides differing from glucose, arabinose, rhamnose and/or xylose. That is to say, $G^1$ comprises ≥90 wt.-%, more preferably ≥95 wt.-%, based on the total weight of the monosaccharide, of glucose and/or arabinose and/or rhamnose and/or xylose.

In the general formula (I), x (also named degree of polymerization (DP)) is in the range of from 1 to 10, preferably x is in the range of from 1.05 to 2.5 and most preferably x is in the range of from 1.10 to 1.8, e.g. from 1.1 to 1.4. In the context of the present invention, x refers to average values, and x is not necessarily a whole number. In a specific molecule only whole groups of $G^1$ can occur. It is preferred to determine x by high temperature gas chromatography (HTGC), e.g. 400° C., in accordance with K. Hill et al., Alkyl Polyglycosides, VCH Weinheim, New York, Basel, Cambridge, Tokyo, 1997, in particular pages 28 ff., or by HPLC. In HPLC methods, x may be determined by the Flory method. If the values obtained by HPLC and HTGC are different, preference is given to the values based on HTGC.

Thus, it is preferred that in the composition comprising two or more compounds of the general formula (I),

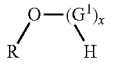

(I)

R is unsubstituted linear $C_{10}$-$C_{20}$-alkyl, preferably unsubstituted linear $C_{10}$-$C_{18}$-alkyl, and $G^1$ is arabinose and/or rhamnose and x is in the range of from 1.05 to 2.5.

Alternatively, in the composition comprising two or more compounds of the general formula (I),

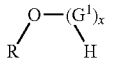

(I)

R is unsubstituted linear $C_{10}$-$C_{20}$-alkyl, preferably unsubstituted linear $C_{10}$-$C_{18}$-alkyl, and $G^1$ is a mixture of glucose, arabinose and xylose and x is in the range of from 1.05 to 2.5.

Preferably, in the composition comprising two or more compounds of the general formula (I),

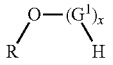

(I)

R is unsubstituted linear $C_{12}$-$C_{18}$-alkyl, preferably unsubstituted linear $C_{12}$-$C_{16}$-alkyl, and most preferably unsubstituted linear $C_{12}$-$C_{14}$-alkyl and $G^1$ is arabinose and/or rhamnose and x is in the range of from 1.10 to 1.8.

Alternatively, in the composition comprising two or more compounds of the general formula (I),

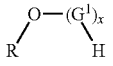

(I)

R is unsubstituted linear $C_{12}$-$C_{18}$-alkyl, preferably unsubstituted linear $C_{12}$-$C_{16}$-alkyl, and most preferably unsubstituted linear $C_{12}$-$C_{14}$-alkyl and $G^1$ is a mixture of glucose, arabinose and xylose and x is in the range of from 1.10 to 1.8.

More preferably, in the composition comprising two or more compounds of the general formula (I),

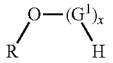

(I)

R is a mixture of unsubstituted linear $C_{12}$-alkyl and $C_{14}$-alkyl and $G^1$ is arabinose and x is in the range of from 1.10 to 1.8.

Alternatively, in the composition comprising two or more compounds of the general formula (I),

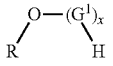

(I)

R is a mixture of unsubstituted linear $C_{12}$-alkyl, $C_{14}$-alkyl, $C_{16}$-alkyl and $C_{18}$-alkyl and $G^1$ is arabinose and x is in the range of from 1.10 to 1.8.

It is appreciated that two or more compounds of the general formula (I) are provided in the composition.

If the composition comprises, preferably consists of, two or more compounds of general formula (I), the two or more compounds present in the composition differ in the groups R and/or $G^1$ and/or x in the general formula (I). That is to say, the groups R and/or $G^1$ and/or x can be independently selected from each other.

For example, if the composition comprises, preferably consists of, two or more compounds of general formula (I), R may be independently selected from unsubstituted linear $C_8$-$C_{20}$-alkyl, preferably unsubstituted linear $C_{10}$-$C_{20}$-alkyl, more preferably unsubstituted linear $C_{10}$-$C_{18}$-alkyl, even more preferably unsubstituted linear $C_{12}$-$C_{18}$-alkyl, and most preferably a mixture of unsubstituted linear $C_{12}$-alkyl, $C_{14}$-alkyl, $C_{16}$-alkyl and $C_{18}$-alkyl, or a mixture of unsubstituted linear $C_{12}$-alkyl and $C_{14}$-alkyl, while $G^1$ and x in the general formula (I) are the same for each compound. Alternatively, x may be independently selected from the range of from 1 to 10, preferably from the range of from 1.05 to 2.5 and most preferably from the range of from 1.10 to 1.8, while R and $G^1$ in the general formula (I) are the same for each compound. Alternatively, $G^1$ may be independently selected from arabinose, rhamnose, xylose and mixtures thereof, while R and x in the general formula (I) are the same for each compound.

Preferably, the two or more compounds of the general formula (I) differ in R. More preferably, the two or more compounds of the general formula (I) differ in R, while $G^1$ and x are the same.

It is appreciated that the compounds of the general formula (I) can be present in the alpha and/or beta conformation. For example, the compound of general formula (I) is in the alpha or beta conformation, preferably alpha conformation. Alternatively, the compound of general formula (I) is in the alpha and beta conformation.

If the compound of general formula (I) is in the alpha and beta conformation, the compound of general formula (I) comprise the alpha and beta conformation preferably in a ratio (a/3) from 10:1 to 1:10, more preferably from 10:1 to 1:5, even more preferably from 10:1 to 1:4 and most preferably from 10:1 to 1:3, e.g. about 2:1 to 1:2.

The composition comprising two or more compounds of the general formula (I) can be preferably used in a dry or liquid formulation.

Thus, the present invention refers in a further aspect to a dry or liquid formulation comprising a composition comprising two or more compounds of the general formula (I).

As regards the composition comprising two or more compounds of the general formula (I), it is referred to the comments provided above when defining said composition and embodiments thereof in more detail.

For example, the dry or liquid formulation is a dry or liquid cleaning formulation.

The term "cleaning" is used herein in the broadest sense and means removal of unwanted substances such as oil- and/or fat-containing substances from an object to be cleaned, e.g. fabrics or dishes.

The term "dry formulation" as used herein, refers to formulations that are in a form of a powder, granules or tablets. It is appreciated that the "dry formulation" has a moisture content of ≤20 wt.-%, more preferably ≤15 wt.-%, even more preferably ≤10 wt.-% and most preferably ≤7.5 wt.-%, based on the total weight of the formulation. If not otherwise indicated, the moisture content is determined according to the Karl Fischer method as outlined in DIN EN 13267:2001. If the dry formulation is provided in form of a powder, the formulation is preferably a high concentrated powder formulation having a bulk density of above 600 g/1.

The term "liquid formulation" as used herein, refers to formulations that are in a form of a "pourable liquid"; "gel" or "paste".

A "pourable liquid" refers to a liquid formulation having a viscosity of <3 000 mPa·s at 25° C. at a shear rate of 20 $sec^{-1}$. For example, the pourable liquid has a viscosity in the range of from 200 to 2 000 mPa·s, preferably from 200 to 1 500 mPa·s and most preferably from 200 to 1 000 mPa·s, at 25° C. at a shear rate of 20 $sec^{-1}$.

A "gel" refers to a transparent or translucent liquid formulation having a viscosity of >2 000 mPa·s at 25° C. at a shear rate of 20 $sec^{-1}$. For example, the gel has a viscosity in the range of from 2 000 to about 10 000 mPa·s, preferably from 5 000 to 10 000 mPa·s, at a shear rate of 0.1 $sec^{-1}$.

A "paste" refers to an opaque liquid formulation having a viscosity of greater than about 2 000 mPa·s at 25° C. and a shear rate of 20 $sec^{-1}$. For example, the paste has a viscosity in the range of from 3 000 to 10 000 mPa·s, preferably from 5 000 to 10 000 mPa·s, at 25° C. at a shear rate of 0.1 $sec^{-1}$.

Preferably the dry or liquid formulation, more preferably the dry or liquid cleaning formulation, is in form of a liquid formulation. The dry or liquid formulation is preferably in form of a single dose formulation.

The dry or liquid formulation, preferably the dry or liquid cleaning formulation, comprises the composition comprising two or more compounds of the general formula (I) preferably in an amount ranging from 0.1 to 80 wt.-%, preferably from 0.1 to 50 wt.-% and most preferably from 0.1 to 25 wt.-%, based on the total weight of the formulation.

It is appreciated that the dry or liquid formulation, preferably the dry or liquid cleaning formulation, may further comprise additives typically used in the kind of formulation to be prepared. For example, the dry or liquid formulation, preferably the dry or liquid cleaning formulation, further comprises additives selected from the group comprising anionic surfactants, nonionic surfactants, cationic surfactants, amphoteric surfactants, enzymes, bleaching agents, peroxygen compounds, optical brightener, complexing agents, polymers, soaps, silicon based defoamers, bleaching agents, colorants, dye transfer inhibitors and mixtures thereof.

Anionic surfactants suitable for the dry or liquid formulation, preferably the dry or liquid cleaning formulation, can be of several different types. For example, the anionic surfactant can be selected from the group comprising alkane sulfonates, olefin sulfonates, fatty acid ester sulfonates, especially methyl ester sulfonates, alkyl phosphonates, alkyl ether phosphonates, sarcosinates, taurates, alkyl ether carboxylates, fatty acid isothionates, sulfosuccinates, $C_8$-$C_{22}$ alkyl sulfates, $C_8$-$C_{22}$ alkyl alkoxy sulfates, $C_{11}$-$C_{13}$ alkyl benzene sulfonate, $C_{12}$-$C_{20}$ methyl ester sulfonate, $C_{12}$-$C_{18}$ fatty acid soap and mixtures thereof.

Nonionic surfactants suitable for the dry or liquid formulation, preferably the dry or liquid cleaning formulation, can be of several different types. For example, the nonionic surfactant can be selected from the group comprising $C_8$-$C_{22}$ alkyl ethoxylates, $C_6$-$C_{12}$ alkyl phenol alkoxylates, preferably ethoxylates and mixed ethoxy/propoxy, block alkylene oxide condensate of $C_6$ to $C_{12}$ alkyl phenols, alkylene oxide condensates of $C_8$-$C_{22}$ alkanols and ethylene oxide/propylene oxide block polymers, alkylpolysaccharides, alkyl polyglucoside surfactants, condensation products of $C_{12}$-$C_{15}$ alcohols with from 5 to 20 moles of ethylene oxide per mole of alcohol, polyhydroxy fatty acid amides, preferably N-methyl N-1-deoxyglucityl cocoamide or N-methyl N-1-deoxyglucityl oleamide, and mixtures thereof. In one embodiment, the nonionic surfactant may be of the formula $R^1(OC_2H_4)_nOH$, wherein $R^1$ is a $C_{10}$-$C_{16}$ alkyl group or a $C_8$-$C_{12}$ alkyl phenyl group, and wherein n is from 3 to about 80.

Additionally or alternatively, the non-ionic surfactant can be a biosurfactant selected from the group comprising rhamnolipid, sophorolipid, glucoselipid, celluloselipid, trehaloselipid, mannosylerythritollipid, lipopeptide and mixtures thereof.

Preferred non-ionic surfactants are glucamides, methylesteralkoxylates, alkoxylated alcohols, di- and multiblock copolymers of ethylene oxide and propylene oxide and reaction products of sorbitan with ethylene oxide or propylene oxide, alkyl polyglycosides (APG), hydroxyalkyl mixed ethers and amine oxides.

Preferred examples of alkoxylated alcohols and alkoxylated fatty alcohols are, for example, compounds of the general formula (III)

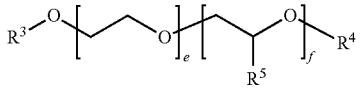

(III)

in which the variables are defined as follows:

$R^3$ is selected from $C_8$-$C_{22}$-alkyl, branched or linear, for example n-$C_8H_{17}$, n-$C_{10}H_{21}$, n-$C_{12}H_{25}$, n-$C_{14}H_{29}$, n-$C_{16}H_{33}$ or n-$C_{18}H_{37}$, $R^4$ is selected from $C_1$-$C_{10}$-alkyl, methyl, ethyl, n-propyl, isopropyl, n-butyl, isobutyl, sec-butyl, tert-butyl, n-pentyl, isopentyl, sec-pentyl, neopentyl, 1,2-dimethylpropyl, isoamyl, n-hexyl, isohexyl, sec-hexyl, n-heptyl, n-octyl, 2-ethylhexyl, n-nonyl, n-decyl or isodecyl, $R^5$ is identical or different and selected from hydrogen and linear $C_1$-$C_{10}$-alkyl, preferably in each case identical and ethyl and particularly preferably hydrogen or methyl, e and f are in the range from zero to 300, where the sum of e and f is at least one, preferably in the range of from 3 to 50. Preferably, e is in the range from 1 to 100 and f is in the range from 0 to 30.

It is appreciated that e and f may be polymerized randomly or as blocks.

In one embodiment, compounds of the general formula (III) may be block copolymers or random copolymers, preference being given to block copolymers.

Other preferred examples of alkoxylated alcohols are, for example, compounds of the general formula (IV)

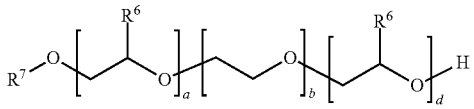

(IV)

in which the variables are defined as follows:

$R^6$ is identical or different and selected from hydrogen and linear $C_1$-$C_{10}$-alkyl, preferably identical in each case and ethyl and particularly preferably hydrogen or methyl, $R^7$ is selected from $C_6$-$C_{20}$-alkyl, branched or linear, in particular n-$C_8H_{17}$, n-$C_{10}H_{21}$, n-$C_{12}H_{25}$, n-$C_{13}H_{27}$, n-$C_{15}H_{31}$, n-$C_{14}H_{29}$, n-$C_{16}H_{33}$, n-$C_{18}H_{37}$, a is a number in the range from zero to 10, preferably from 1 to 6, b is a number in the range from 1 to 80, preferably from 4 to 20, d is a number in the range from zero to 50, preferably 4 to 25.

The sum a+b+d is preferably in the range of from 5 to 100, even more preferably in the range of from 9 to 50.

Compounds of the general formula (III) and (IV) may be block copolymers or random copolymers, preference being given to block copolymers.

Further suitable nonionic surfactants are selected from di- and multiblock copolymers, composed of ethylene oxide and propylene oxide. Further suitable nonionic surfactants are selected from ethoxylated or propoxylated sorbitan esters. Amine oxides or alkyl polyglycosides, especially linear $C_4$-$C_{16}$-alkyl polyglucosides and branched $C_8$-$C_{14}$-alkyl polyglycosides such as compounds of general average formula (VI) are likewise suitable.

(VI)

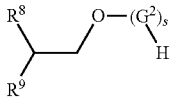

wherein:

$R^8$ is $C_1$-$C_4$-alkyl, in particular ethyl, n-propyl or isopropyl, $R^9$ is —$(CH_2)_2$—$R^7$, $G^2$ is selected from monosaccharides with 4 to 6 carbon atoms, especially from glucose and xylose, s in the range of from 1.1 to 4, s being an average number, Further examples of non-ionic surfactants are compounds of general formula (VII) and (VIII)

(VII)

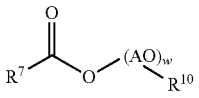

(VIII)

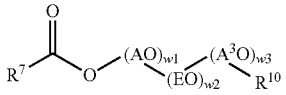

$R^7$ is defined as above in general formula (IV).

AO corresponds to the group f as defined above in general formula (III) or the group a or d as defined above in general formula (IV).

$R^{10}$ selected from $C_8$-$C_{18}$-alkyl, branched or linear.

$A^3O$ is selected from propylene oxide and butylene oxide, w is a number in the range of from 15 to 70, preferably 30 to 50, w1 and w3 are numbers in the range of from 1 to 5, and w2 is a number in the range of from 13 to 35.

An overview of suitable further nonionic surfactants can be found in EP-A 0 851 023 and in DE-A 198 19 187 which are incorporated herewith by reference.

Mixtures of two or more different nonionic surfactants selected from the foregoing may also be present.

Cationic surfactants suitable for the dry or liquid formulation, preferably the dry or liquid cleaning formulation, can be of several different types. For example, useful cationic surfactants can be selected from fatty amines, quaternary ammonium surfactants, imidazoline quat materials and mixtures thereof.

Amphoteric surfactants are also suitable for use in the dry or liquid formulation, preferably the dry or liquid cleaning formulation, and can be of several different types. For example, the amphoteric surfactants can be selected from aliphatic derivatives of secondary or tertiary amines and/or aliphatic derivatives of heterocyclic secondary and tertiary amines in which the aliphatic radical can be a straight- or branched-chain. It is preferred that one of the aliphatic substituents contains at least 8 carbon atoms, preferably from 8 to 18 carbon atoms, and at least one contains an anionic water-solubilizing group, e.g., a carboxy, sulfonate or sulfate group.

The present dry or liquid formulation, preferably the dry or liquid cleaning formulation, may also comprise enzymes, such as for the removal of protein-based, carbohydrate-based or triglyceride-based stains. For example, suitable enzymes are selected from the group comprising hemicellulases, peroxidases, proteases, cellulases, xylanases, lipases, phospholipases, esterases, cutinases, pectinases, keratanases, reductases, oxidases, phenoloxidases, lipoxygenases, ligninases, pullulanases, tannases, pentosanases, malanases, β-glucanases, arabinosidases, hyaluronidase, chondroitinase, laccase, amylases, and mixtures thereof. They may be of any suitable origin, such as vegetable, animal, bacterial, fungal and yeast origin.

In one embodiment, the dry or liquid formulation, preferably the dry or liquid cleaning formulation, comprises a mixture of conventional enzymes like protease, lipase, cutinase and/or cellulase in combination with amylase.

Proteases useful herein include those like subtilisins from Bacillus [e.g. subtilis, lentus, licheniformis, amyloliquefaciens (BPN, BPN'), alcalophilus] such as the commercial products Esperase®, Alcalase®, Everlase® or Savinase® available from Novozymes. Commercial products of amylases (α and/or β) are for example available as Purafect Ox Am® from Genencor or Termamyl®, Natalase®, Ban®, Fungamyl® and Duramyl® from Novozymes. Suitable lipases include those produced by Pseudomonas and Chromobacter groups. The lipolase enzymes can be derived from Humicola lanuginosa and are commercially available from Novo or as Lipolase Ultra®, Lipoprime® and Lipex® from Novozymes. Also suitable are cutinases and esterases. Suitable cellulases include both bacterial and fungal types, typically having a pH optimum between 5 and 10. Examples include fungal cellulases from Humicola insolens or Humicola strain DSMI 800 or a cellulase 212-producing fungus belonging to the genus Aeromonas, and cellulase extracted from the hepatopancreas of a marine mollusk, Dolabella Auricula Solander. CAREZYME® ENDOLASE and CELLUZYME® of Novozymes or the EGIII cellulases from Trichoderma longibrachiatum are also suitable.

Bleaching enzymes can be used as bleaching agents e.g. peroxidases, laccases, oxygenases, e.g. catechol 1,2 dioxygenase, lipoxygenase, (non-heme) haloperoxidases.

The peroxygen compounds that can be used in the present dry or liquid formulation, preferably the dry or liquid cleaning formulation, are normally compounds which are capable of yielding hydrogen peroxide in aqueous solution and are well known in the art. For example, the peroxygen compounds can be selected from the group comprising alkali metal peroxides, organic peroxides such as urea peroxide, and inorganic persalts, such as the alkali metal perborate such as sodium perborate tetrahydrate or sodium perborate monohydrate, percarbonates, perphosphates, persilicates, alkylhydroxy peroxides such as cumene hydroperoxide or t-butyl hydroperoxide, organic peroxyacids such as monoperoxy acids (e.g. peroxy-α-naphthoic acid, peroxylauric acid, peroxystearic acid and N,N-phthaloylaminoperoxy caproic acid (PAP), 6-octylamino-6-oxo-peroxyhexanoic acid, 1,12-diperoxydodecanedioic acid (DPDA), 2-decylperoxybutane-1,4-dioic acid or 4,4'-sulphonylbisperoxybenzoic acid) and mixtures thereof.

Optical brighteners include any compound that exhibits fluorescence, including compounds that absorb UV light and reemit as "blue" visible light. In particular, suitable optical brighteners absorb light in the ultraviolet portion of the spectrum between about 275 nm and about 400 nm and emit light in the violet to violet-blue range of the spectrum from about 400 nm to about 500 nm. For example, the optical brighteners contain an uninterrupted chain of conjugated double bonds. Examples of suitable optical brighteners include derivatives of stilbene or 4,4'-diaminostilbene, biphenyl, five-membered heterocycles such as triazoles, oxazoles, imidiazoles, etc., or six-membered heterocycles (e.g. coumarins, naphthalamide, s-triazine, etc.). Cationic, anionic, nonionic, amphoteric and zwitterionic optical brightener can be used in the present dry or liquid formulation, preferably the dry or liquid cleaning formulation.

The present dry or liquid formulation, preferably the dry or liquid cleaning formulation, may also comprise complexing agents, e.g. iron and manganese complexing agents. Such complexing agents can be selected from the group comprising amino carboxylates, amino phosphonates, polyfunctionally-substituted aromatic complexing agents and mixtures thereof. Suitable complexing agents are selected from the alkali metal salts of aminocarboxylic acids and from alkali metal salts of citric acid, tartaric acid and lactic acid. Alkali metal salts are selected from lithium salts, rubidium salts, cesium salts, potassium salts and sodium salts, and combinations of at least two of the foregoing. Potassium salts and combinations from potassium and sodium salts are preferred and sodium salts are even more preferred.

Examples of aminocarboxylic acids are imino disuccinic acid (IDS), ethylene diamine tetraacetic acid (EDTA), nitrilotriacetic acid (NTA), methylglycine diacetic acid (MGDA) and glutamic acid diacetic acid (GLDA).

In one embodiment of the present invention, formulations according to the invention can contain at least one organic complexing agent (organic cobuilders) such as EDTA (N,N,N',N'-ethylenediaminetetraacetic acid), NTA (N,N,N-nitrilotriacetic acid), MGDA (2-methylglycine-N,N-diacetic acid), GLDA (glutamic acid N,N-diacetic acid), and phosphonates such as 2-phosphono-1,2,4-butanetricarboxylic acid, aminotri(methylenephosphonic acid), 1-hydroxyethylene(1,1-diphosphonic acid) (HEDP), ethylenediaminetetramethylenephosphonic acid, hexamethylenediaminetetramethylenephosphonic acid and diethylenetriaminepentamethylenephosphonic acid and in each case the respective alkali metal salts, especially the respective sodium salts. Preferred are the sodium salts of HEDP, of GLDA and of MGDA.

The present dry or liquid formulation, preferably the dry or liquid cleaning formulation, may also comprise polymers, e.g. polycarboxylates.

The dry or liquid formulation, preferably the dry or liquid cleaning formulation, preferably comprises one or more of the above additives (in sum) in an amount ranging from 0.5 to 25 wt.-%, preferably from 0.5 to 20 wt.-% and most preferably from 0.5 to 17.5 wt.-%, based on the total weight of the active materials in the formulation. It is to be noted that the total weight of the active materials in the formulation (if not otherwise indicated) refers to the total weight of the one or more additives and the compound of the general formula (I), i.e. without water.

It is appreciated that the composition comprising two or more compounds of the general formula (I),

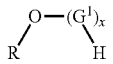

(I)

wherein R is unsubstituted linear $C_8$-$C_{20}$-alkyl, $G^1$ is selected from glucose, arabinose, rhamnose, xylose and mixtures thereof; x is in the range of from 1 to 10 and refers to average values, and wherein the two or more compounds differ in R and/or $G^1$ and/or x, shows high efficiency as surfactant.

Thus, the present invention refers in another aspect to the use of the composition comprising two or more compounds of the general formula (I)

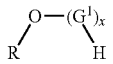

(I)

wherein R is unsubstituted linear $C_8$-$C_{20}$-alkyl, $G^1$ is selected from glucose, arabinose, rhamnose, xylose and mixtures thereof; x is in the range of from 1 to 10 and refers to average values, and wherein the two or more compounds differ in R and/or $G^1$ and/or x, as surfactant.

As regards the composition comprising two or more compounds of the general formula (I), it is referred to the comments provided above when defining said composition and embodiments thereof in more detail.

It is appreciated that the efficiency as surfactant of the composition comprising two or more compounds of the general formula (I), can be achieved over a broad temperature range. Thus, the composition comprising two or more compounds of the general formula (I) is preferably used as surfactant at a temperature ranging from 5 to 120° C. Accordingly, the composition comprising two or more compounds of the general formula (I) is preferably used as surfactant in home care laundry products, industrial laundry products, manual dishwashing and the like, most preferably home care laundry products.

Preferably, the composition comprising two or more compounds of the general formula (I) is used as surfactant in a laundry process. In view of the above, the laundry process can be carried out at a temperature ranging from 5 to 120° C., preferably at a temperature ranging from 5 to 100° C.

It is appreciated that the composition comprising two or more compounds of the general formula (I),

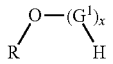

(I)

wherein R is unsubstituted linear $C_8$-$C_{20}$-alkyl, $G^1$ is selected from glucose, arabinose, rhamnose, xylose and mixtures thereof; x is in the range of from 1 to 10 and refers to average values, and wherein the two or more compounds differ in R and/or $G^1$ and/or x, shows exceptional results as anti-greying agent when used in a laundry process.

Thus, the present invention refers in a further aspect to the use of the composition comprising two or more compounds of the general formula (I)

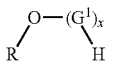

(I)

wherein R is unsubstituted linear $C_8$-$C_{20}$-alkyl, $G^1$ is selected from glucose, arabinose, rhamnose, xylose and mixtures thereof; x is in the range of from 1 to 10 and refers to average values, and wherein the two or more compounds differ in R and/or $G^1$ and/or x, as anti-greying agent in a laundry process.

As regards the composition comprising two or more compounds of the general formula (I), it is referred to the comments provided above when defining said composition and embodiments thereof in more detail.

In particular, the composition comprising two or more compounds of the general formula (I) used as anti-greying agent reduces greying of a washed fabric. The fabric may be selected from a natural fabric, synthetic fabric and mixtures thereof. For example, the natural fabric may be a cotton, linen and/or silk fabric. The synthetic fabric may be a polyester and/or polyamide fabric. A mixed natural/synthetic fabric may be for example a polyester/cotton fabric.

It is appreciated that the anti-greying performance of the composition comprising two or more compounds of the general formula (I), can be achieved over a broad temperature range. Thus, the composition comprising two or more compounds of the general formula (I) is preferably used as anti-greying agent at a temperature ranging from 5 to 120° C. In view of this, the laundry process can be carried out at a temperature ranging from 5 to 120° C., preferably at a temperature ranging from 5 to 100° C. Accordingly, the composition comprising two or more compounds of the general formula (I) is preferably used as anti-greying agent in home care laundry products, industrial laundry products and the like, most preferably home care laundry products.

The scope and interest of the invention will be better understood based on the following examples which are intended to illustrate certain embodiments of the invention and are non-limitative.

EXAMPLES

Example 1

The efficiency of the composition comprising two or more compounds of formula (I) as surfactant was demonstrated by using the launder-o-meter in comparison to compounds of the prior art.

The surfactant efficiency for the selected composition comprising two or more compounds of formula (I) was determined in the launder-o-meter as follows:

Several soil swatches were washed together with cotton ballast fabric and 20 steel balls at 25° C. for 20 min in water in the launder-o-meter with the selected composition comprising two or more compounds of formula (I) or comparative compound. The compositions comprising two or more compounds used as well as the comparative compounds are outlined in tables 1a and 1b for surfactant dosages of 0.1 g/L and 1 g/L. After the washing, the fabrics were rinsed, spin-dried and dried in the air.

TABLE 1a

Tested compounds and results for a surfactant dosage of 0.1 g/L

| | Fabric | Remission before washing [%] | Remission after washing [%] | Δ (remission difference before and after washing) | ΔΔ (remission difference to reference) |
|---|---|---|---|---|---|
| Reference (only water) | CFT-CS 62 | 14.7 | 31.1 | 16.4 | — |
| C13-C15 Oxo alcohol + 7 mol EO# (CE1) | CFT-CS 62 | 14.7 | 29.6 | 14.9 | −1.5 |
| linear C12-C14* Arabinosid#1 (IE1) | CFT-CS 62 | 14.7 | 31.8 | 17.1 | 0.7 |
| Reference (only water) | CFT-CS 61 | 14.5 | 25.7 | 11.2 | — |
| C13-C15 Oxo alcohol + 7 mol EO# (CE2) | CFT-CS 61 | 14.5 | 30.1 | 15.6 | 4.4 |
| linear C12-C14* Arabinosid#1 (IE2) | CFT-CS 61 | 14.5 | 30.8 | 16.3 | 5.1 |

#active content: 100 wt.-%, based on the total weight of the surfactant.

#1active content: 37 wt.-%, based on the total weight of the surfactant.

*the compound is prepared from a mixture of linear alcohols comprising 0-2 wt.-% C10, 65-75 wt.-% C12, 22-30 wt.-% C14, 0-8 wt.-% C16 and 0-0.5 wt.-% C18, based on the total weight of the alcohol mixture.

TABLE 1b

Tested compounds and results for a surfactant dosage of 1 g/L

| | Fabric | Remission before washing [%] | Remission after washing [%] | Δ (remission difference before and after washing) | ΔΔ (remission difference to reference) |
|---|---|---|---|---|---|
| Reference (only water) | CFT-CS 62 | 14.7 | 31.1 | 16.4 | — |
| C13-C15 Oxo alcohol + 7 mol EO# (CE3) | CFT-CS 62 | 14.7 | 28.7 | 14.0 | −2.4 |
| linear C12-C14* Arabinosid#1 (IE3) | CFT-CS 62 | 14.7 | 48.9 | 34.2 | 17.8 |
| linear C12-C14* Rhamnosid#2 (IE4) | CFT-CS 62 | 14.7 | 49.4 | 34.7 | 18.3 |
| Reference (only water) | CFT-CS 61 | 14.5 | 25.7 | 11.2 | — |
| C13-C15 Oxo alcohol + 7 mol EO# (CE4) | CFT-CS 61 | 14.5 | 28.2 | 13.7 | 2.5 |
| linear C12-C14* Arabinosid#1 (IE5) | CFT-CS 61 | 14.5 | 51.1 | 36.6 | 25.4 |
| linear C12-C14* Rhamnosid#2 (IE6) | CFT-CS 61 | 14.5 | 52.0 | 37.5 | 26.3 |

#active content: 100 wt.-%, based on the total weight of the surfactant.
#1active content: 37 wt.-%, based on the total weight of the surfactant.
#2active content: 100 wt.-%, based on the total weight of the surfactant.
*the compound is prepared from a mixture of linear alcohols comprising 0-2 wt.-% C10, 65-75 wt.-% C12, 22-30 wt.-% C14, 0-8 wt.-% C16 and 0-0.5 wt.-% C18, based on the total weight of the alcohol mixture.

The washing conditions are outlined in table 2 below.

TABLE 2

Washing conditions:

| | |
|---|---|
| Test equipment | Launder-o-meter, LP2 Typ, SDL Atlas Inc., USA |
| Washing liquor | 250 ml |
| Washing time/temperature | 20 min at 25° C. |
| Dosage | 0.1 g or 1 g tested compound/L |
| Fabric/liquor ratio | 1:12.5 |
| Washing cycles | 1 |
| Water hardness | 2.5 mmol/l $Ca^{2+}$:$Mg^{2+}$:$HCO_3^-$ 4:1:8 |
| Ballast fabric | 15 g cotton fabric 283 |
| Sum ballast + soiled fabric | 20 g |
| Soiled fabric | 5 g CFT-CS 62[1)]<br>5 g CFT-CS 61[2)] |

[1)]CFT-CS 62, cotton fabric soiled with lard, Remission 13.9%
[2)]CFT-CS 61, cotton fabric soiled with beef fat, Remission 12.5%
[1)2)] Producer: Center for Testmaterials BV, NL-3130 AC Vlaardingen The efficiency as surfactant was determined by measuring the remission value of the soiled fabric before and after washing with the spectrophotometer from Fa. Datacolor (Elrepho 2000) at 460 nm. The higher the value, the better is the performance. The results are outlined in Tables 1a and 1b above. From the results, it can be gathered that the inventive compositions comprising two or more compounds of formula (I) show excellent efficiency as surfactant compared to compounds of the prior art.

Example 2

The excellent anti-greying properties of the composition comprising two or more compounds of formula (I) were demonstrated by using the launder-o-meter in comparison to a compound of the prior art as follows:

Several white test swatches were washed together with soiled fabric EMPA 101/SBL 2004 and 20 steel balls at 40° C. in water with the selected composition comprising two or more compounds of formula (I) or comparative compound. The pH value of the washing liquor was adjusted to 8.0. The compositions comprising two or more compounds used as well as the comparative compounds are outlined in table 3. After the washing, the test fabrics were rinsed and spin-dried. This washing cycle was repeated two times with new soiled fabric and new washing liquor. After the third wash, the test fabrics were rinsed, spin-dried and dried in the air.

TABLE 3

Tested compounds and results

| | Soiling | Δ cotton (BW) | Δ polyester (PES) | sum (ΔBW + Δ PES) |
|---|---|---|---|---|
| C13-C15 Oxo alcohol + 7 mol EO# (CE1) | EMPA/SBL | −3.5 | 43.5 | 40.0 |
| linear C12-C14* Arabinosid#1 (IE1) | EMPA/SBL | 16.7 | 40.1 | 56.8 |
| linear C12-C14* Xylosid#3 (IE3) | EMPA/SBL | 21.3 | 34.0 | 55.3 |
| linear C12-C14* Glycosid (66% Glu/33% Xyl/1% Ara)#4 (IE4) | EMPA/SBL | 22.7 | 43.8 | 66.5 |
| C13-C15 Oxo alcohol + 7 mol EO# (CE2) | Clay slurry | −0.6 | 10.0 | 9.4 |
| linear C12-C14* Arabinosid#1 (IE5) | Clay slurry | 111.7 | 44.3 | 156.0 |
| linear C12-C14* Rhamnosid#2 (IE6) | Clay slurry | 31.4 | 22.6 | 54.0 |

TABLE 3-continued

| Tested compounds and results | | | | |
|---|---|---|---|---|
| | Soiling | Δ cotton (BW) | Δ polyester (PES) | sum (ΔBW + Δ PES) |
| linear C12-C14* Xylosid[#3] (IE7) | Clay slurry | 65.4 | 31.0 | 96.4 |
| linear C12-C14* Glycosid (66% Glu/33% Xyl/1% Ara)[#4] (IE8) | Clay slurry | 71.3 | 27.0 | 98.3 |

[#]active content: 100 wt.-%, based on the total weight of the composition comprising two or more compounds of formula (I).
[#1]active content: 63 wt.-%, based on the total weight of the composition comprising two or more compounds of formula (I).
[#2]active content: 100 wt.-%, based on the total weight of the composition comprising two or more compounds of formula (I).
[#3]active content: 100 wt.-%, based on the total weight of the composition comprising two or more compounds of formula (I).
[#4]active content: 46 wt.-%, based on the total weight of the composition comprising two or more compounds of formula (I).
*the compound is prepared from a mixture of linear alcohols comprising 0-2 wt.-% C10, 65-75 wt.-% C12, 22-30 wt.-% C14, 0-8 wt.-% C16 and 0-0.5 wt.-% C18, based on the total weight of the alcohol mixture.

The washing conditions are outlined in table 4 below.

TABLE 4

| Washing conditions: | |
|---|---|
| Test equipment | Launder-o-meter, LP2 Typ, SDL Atlas Inc., USA |
| Washing liquor | 250 ml |
| Washing time/temperature | 30 min at 40° C. |
| Dosage | 1 g tested compound/L |
| Fabric/liquor ratio | 1:10 |
| Washing cycles | 3 |
| Water hardness | 2.5 mmol/l $Ca^{2+}$:$Mg^{2+}$:$HCO_3^-$ 4:1:8 |
| Soiling fabric | 2.5 g EMPA 101[5)]<br>2.5 g SBL 2004[6)]<br>2.5 g clay slurry[7)] |
| Sum test + soiled fabric | 20 g |
| White test fabric, each 10 × 10 cm | wfk 10A, wfk 80A, wfk12A, EMPA 221[1)]<br>wfk 20A[2)]<br>wfk 30A[3)]<br>EMPA 406[4)] |

[1)]Cotton fabrics: wfk 10A, Remission 81.8%; producer: wfk Testgewebe GmbH, Brüggen, Deutschland wfk 80A, Remission 85.7%; producer: wfk Testgewebe GmbH, Brüggen, Deutschland wfk 12A, Remission 94.4%; producer: wfk Testgewebe GmbH, Brüggen, Deutschland EMPA 221, Remission 87.1%; producer: EMPA Testmaterialien AG, Sankt Gallen, Schweiz
[2)]wfk 20 A Polyester/cotton, Remission 83.4%; producer: wfk Testgewebe GmbH, Br üggen, Deutschland
[3)]wfk 30 A Polyester, Remission 81.2%; producer: wfk Testgewebe GmbH, Brüggen, Deutschland
[4)]EMPA 406 Polyamid, Remission 77.1%; producer: EMPA Testmaterialien AG, Sankt Gallen, Schweiz
[5)]EMPA 101, Carbon black/Olive oil; producer: producer: EMPA Testmaterialien AG, Sankt Gallen, Schweiz
[6)]SBL 2004, Soil load sheet; producer: wfk Testgewebe GmbH, Brüggen, Deutschland
[7)]mixture of clay, peanut oil, mineral oil and water The anti-greying performance was determined by measuring the remission value of the soiled fabric before and after wash with the spectrophotometer from Fa. Datacolor (Elrepho 2000) at 460 nm. The higher the value, the better is the performance. The results are outlined in Table 3 above. From the results, it can be gathered that the inventive compositions comprising two or more compounds of formula (I) show excellent anti-greying performance compared to compounds of the prior art.

The invention claimed is:

1. A composition comprising nonionic surfactants, wherein the nonionic surfactants consist of:

(A) two or more compounds of the general formula (I),

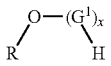

(I)

wherein R is a mixture of unsubstituted linear $C_{12}$-alkyl and $C_{14}$-alkyl, $G^1$ is arabinose and/or rhamnose, or $G^1$ is a mixture of glucose, arabinose and xylose; x is in the range of from 1 to 10 and refers to average values, and wherein the two or more compounds differ in $G^1$ and/or x; and (B) optionally one or more nonionic surfactants selected from the group consisting of $C_8$-$C_{22}$ alkyl ethoxylates, $C_6$-$C_{12}$ alkyl phenol alkoxylates, block alkylene oxide condensate of $C_6$ to $C_{12}$ alkyl phenols, alkylene oxide condensates of $C_8$-$C_{22}$ alkanols and ethylene oxide/propylene oxide block polymers, condensation products of $C_{12}$-$C_{15}$ alcohols with from 5 to 20 moles of ethylene oxide per mole of alcohol, polyhydroxy fatty acid amides, and mixtures thereof.

2. The composition according to claim 1, wherein x is in the range of from 1.05 to 2.5.

3. The composition according to claim 1, wherein $G^1$ is arabinose and/or rhamnose and x is in the range of from 1.05 to 2.5.

4. The composition according to claim 1, wherein $G^1$ is arabinose and/or rhamnose and x is in the range of from 1.10 to 1.8.

5. A dry or liquid formulation comprising the composition of claim 1.

6. The dry or liquid formulation according to claim 5, wherein the formulation further comprises additives selected from the group consisting of anionic surfactants, cationic surfactants, amphoteric surfactants, enzymes, bleaching agents, peroxygen compounds, optical brightener, complexing agents, polymers, soaps, silicon based defoamers, bleaching agents, colorants, dye transfer inhibitors and mixtures thereof.

7. The dry or liquid formulation according to claim 5, wherein the formulation is a single dose formulation or a high concentrated powder formulation having a bulk density of above 600 g/l.

8. A nonionic surfactant consisting of:

(A) two or more compounds of the general

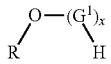

(I)

formula (I), wherein R is a mixture of unsubstituted linear $C_{12}$-alkyl and $C_{14}$-alkyl, $G^1$ is arabinose and/or rhamnose, or $G^1$ is a mixture of glucose, arabinose and xylose; x is in the range of from 1 to 10 and refers to average values, and wherein the two or more compounds differ in $G^1$ and/or x; and (B) optionally one or more nonionic surfactants selected from the group consisting of $C_8$-$C_{22}$ alkyl ethoxylates, $C_6$-$C_{12}$ alkyl phenol alkoxylates, block alkylene oxide condensate of $C_6$ to $C_{12}$ alkyl phenols, alkylene oxide condensates of $C_8$-$C_{22}$ alkanols and ethylene oxide/propylene oxide block polymers, condensation products of $C_{12}$-$C_{15}$ alcohols with from 5 to 20 moles of ethylene oxide per mole of alcohol, polyhydroxy fatty acid amides, and mixtures thereof.

9. The surfactant according to claim 8, wherein the surfactant is a surfactant for a laundry process.

10. An anti-greying agent in a laundry process comprising nonionic surfactants, wherein the nonionic surfactants consist of:

(A) two or more compounds of the general formula (I),

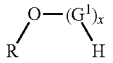

(I)

wherein R is a mixture of unsubstituted linear $C_{12}$-alkyl and $C_{14}$-alkyl, $G^1$ is arabinose and/or rhamnose, or $G^1$ is a mixture of glucose, arabinose and xylose; x is in the range of from 1 to 10 and refers to average values, and wherein the two or more compounds differ in $G^1$ and/or x; and (B) optionally one or more nonionic surfactants selected from the group consisting of $C_8$-$C_{22}$ alkyl ethoxylates, $C_6$-$C_{12}$ alkyl phenol alkoxylates, block alkylene oxide condensate of $C_6$ to $C_{12}$ alkyl phenols, alkylene oxide condensates of $C_8$-$C_{22}$ alkanols and ethylene oxide/propylene oxide block polymers, condensation products of $C_{12}$-$C_{15}$ alcohols with from 5 to 20 moles of ethylene oxide per mole of alcohol, polyhydroxy fatty acid amides, and mixtures thereof.

11. The composition according to claim 1, wherein x is in the range of from 1.10 to 1.8.

* * * * *